US009399891B2

(12) United States Patent
Ahn et al.

(10) Patent No.: US 9,399,891 B2
(45) Date of Patent: Jul. 26, 2016

(54) DRILLING SYSTEM HAVING SLOT FOR UNDERWATER STORAGE OF BOP ASSEMBLY

(75) Inventors: You-Won Ahn, Ulsan (KR); Young-Chul Lee, Ulsan (KR); Bum-Serk Chae, Seoul (KR); Hyung-Kwan Kim, Ulsan (KR); Je-Jin Jang, Ulsan (KR)

(73) Assignee: HYUNDAI HEAVY INDUSTRIES CO., LTD., Ulsan (KR)

( * ) Notice: Subject to any disclaimer, the term of this patent is extended or adjusted under 35 U.S.C. 154(b) by 84 days.

(21) Appl. No.: 14/125,703

(22) PCT Filed: Jun. 14, 2012

(86) PCT No.: PCT/KR2012/004681

§ 371 (c)(1),
(2), (4) Date: Jan. 23, 2014

(87) PCT Pub. No.: WO2012/173395

PCT Pub. Date: Dec. 20, 2012

(65) Prior Publication Data

US 2015/0034327 A1 Feb. 5, 2015

(30) Foreign Application Priority Data

Jun. 14, 2011 (KR) ..... 10-2011-0057308

(51) Int. Cl.

| | |
|---|---|
| ***E21B 17/01*** | (2006.01) |
| ***E21B 7/12*** | (2006.01) |
| ***E21B 33/064*** | (2006.01) |

(Continued)

(52) U.S. Cl.
CPC . *E21B 7/12* (2013.01); *E21B 15/02* (2013.01); *E21B 17/012* (2013.01); *E21B 19/002* (2013.01); *E21B 19/004* (2013.01); *E21B 33/064* (2013.01)

(58) Field of Classification Search
CPC ..... E21B 7/12; E21B 7/128; E21B 15/02
USPC ..... 166/367, 350, 351, 352, 360, 85.4
See application file for complete search history.

(56) References Cited

U.S. PATENT DOCUMENTS

| | | | |
|---|---|---|---|
| 3,987,910 | A | 10/1976 | Brunato |
| 6,321,675 | B1 | 11/2001 | Dybdahl et al. |
| 8,291,845 | B2 | 10/2012 | Wijning et al. |

(Continued)

FOREIGN PATENT DOCUMENTS

| | | | |
|---|---|---|---|
| KR | 10-2001-0032980 | A | 4/2001 |
| KR | 10-2011-0009086 | A | 1/2011 |
| KR | 10-2011-0061872 | A | 6/2011 |

*Primary Examiner* — Matthew R Buck
*Assistant Examiner* — Patrick Lambe
(74) *Attorney, Agent, or Firm* — Rabin & Berdo, P.C.

(57) ABSTRACT

A drilling system includes a derrick installed on a platform of a stationary floating structure. An activity forms a borehole in a sea-bed, and carries out installation of a casing pipe assembly and a BOP assembly in the formed borehole. A BOP trolley forms the BOP assembly together with the activity, and moves while supporting the formed BOP assembly thereon. A slot is formed on a work stand of a moon pool for underwater storage of the BOP assembly so as to extend parallel with the direction of movement of the BOP trolley, and suppresses shaking of risers when the BOP assembly positioned underwater is moved by the BOP trolley and the BOP assembly is moved to an underwater storage position.

5 Claims, 6 Drawing Sheets

(51) Int. Cl.
*E21B 19/00* (2006.01)
*E21B 15/02* (2006.01)

(56) References Cited

U.S. PATENT DOCUMENTS

2007/0251725 A1* 11/2007 Banks ..... 175/5
2009/0126616 A1* 5/2009 Srinivasan ..... 114/264
2010/0057279 A1* 3/2010 Kyllingstad ..... E21B 19/09 701/21
2011/0036287 A1 2/2011 Wijning et al.
2011/0048310 A1 3/2011 Roodenburg et al.
2012/0018166 A1* 1/2012 Croatto ..... E21B 19/006 166/355

* cited by examiner

DRILLING SYSTEM HAVING SLOT FOR UNDERWATER STORAGE OF BOP ASSEMBLY

TECHNICAL FIELD

The present invention relates, in general, to a drilling system which drills boreholes in the seabed for exploration of the sub-bottom structure or for resource extraction and, more particularly, to a drilling system which further includes a trolley for a BOP assembly and a slot for underwater storage of the BOP assembly, which assembles drilling equipment such as the BOP assembly prior to deployment, which is required when drilling is performed, and allows the drilling equipment to be stored and moved, in addition to an activity which is provided to form boreholes, such that, when required to be moved short-distances for the purpose of drilling additional boreholes or another purposes, a drillship can move with the BOP assembly suspended underwater without requiring the BOP assembly to be retracted to the hull of the drillship.

BACKGROUND ART

Generally, for the exploration and extraction of sub-bottom resources, boreholes are formed in the seabed using drilling equipment mounted on a platform of a stationary or movable structure.

FIG. 1 shows the construction of a conventional drilling system, and the procedure of drilling a borehole will be described with reference to FIG. 1.

A drill pipe 21 having a drill bit 22 on a lower tip thereof is mounted to a top drive 20 installed in a derrick 10. Here, the top drive rotates the drill pipe, and is coupled to a travelling block 30, which is supported by a crown block 40 installed on an upper portion of the derrick so as to move vertically, such that the top drive can move vertically along with the travelling block. Thus, when the drill pipe rotates while moving down, with cooperation of the top drive and the crown block, the borehole is formed in the seabed, and as the depth of the bore hole to be drilled increases, the length of the drill pipe is extended depending on the increased depth by additionally assembling a unit piece to the drill pipe.

When the borehole has been formed to a certain depth, a casing pipe 50 is inserted into and cemented with the borehole to prevent the collapse of the borehole.

Next, the borehole is further dilled to a certain depth using a smaller diameter drill bit, and another casing pipe, a diameter of which is smaller than that of the previously inserted casing pipe, is inserted into and cemented with the borehole.

The formation of the borehole and the coupling of the casing pipe into the borehole are repeated so as to form a borehole having a desired depth. To prevent a sudden gush of pressurized gas, water or oil in the seabed through the borehole in the formation of the borehole, a blow out preventer (BOP) 60 is installed on an upper portion of the borehole (or the casing pipe) in such a manner as to be coupled to a platform 70 by a riser 61.

Installation of the casing pipe or the riser is carried out by assembling a plurality of unit pieces each having a certain length into a single assembly, and installing the assembly into the borehole or on the BOP.

The formation and installation of the assembly is carried out by an activity arranged in the derrick, wherein the activity is composed of the crown block 30, the travelling block 40, the top drive 20, and a rotary table 80.

However, the conventional drilling system is of a single-activity type in which one activity is provided in the derrick, so that, when one of drilling, assembly and installation of the casing pipes, and assembly and installation of the risers is being performed by the activity, another process cannot be carried out in parallel with the ongoing process.

That is, when the drill pipe is installed on the top drive and is drilling the borehole, the casing pipes or the risers cannot be assembled. In this case, after the borehole is completely drilled until the formed borehole has a desired depth, the drill bit and the drill pipe should be separated from the top drive, and then the casing pipes or the risers are to be assembled and installed. This degrades working efficiency and extends working time.

Also, in the case of the single activity type drilling system, when the BOP is to be separated from a currently-drilled borehole in order to form another borehole, the riser and the BOP are first separated and lifted from the borehole (or the casing pipe) using the activity, and the riser and the BOP are stored in a predetermined storage after completely disassembled. This should be done because, if the BOP assembly (including the BOP and the riser) separated from the borehole is left on the activity as it is, other work cannot be done. Thus, for reuse, the disassembled BOP assembly should be reassembled, inevitably consuming much time.

DISCLOSURE

Technical Problem

Accordingly, the present invention has been made keeping in mind the above problems occurring in the related art, and an object of the present invention is to provide a drilling system having a slot for underwater storage of a BOP assembly, wherein a drillship can move by enabling a BOP assembly to be suspended underwater without requiring the BOP assembly to be retracted to the hull of the drillship if the short-distance movements, in which the BOP assembly may be suspended underwater for the purpose of drilling another hole or for another purpose, are required.

Another object of the present invention is to provide a drilling system further allowing an auxiliary activity as well as an activity to implement drilling such that a casing pipe assembly is formed during drilling, thereby improving drilling efficiency.

Technical Solution

In order to accomplish the above object(s), the present invention provides a drilling system including: a derrick which is installed on a platform of a stationary structure or a floating structure; an activity which is installed on the derrick, forms a borehole in a sea-bed, and carries out installation of a casing pipe assembly and a BOP assembly in the formed borehole; a BOP trolley, which is installed to be positioned on the lower part of the derrick, forms the BOP assembly by assembling a plurality of risers and BOPs, in cooperation with the activity, and moves while supporting the formed BOP assembly thereon; and a slot which is formed on a work stand of a moon pool for underwater storage of the BOP assembly so as to extend parallel with the direction of movement of the BOP trolley, and suppresses shaking of the risers that are extended from the BOP assembly when the BOP assembly positioned underwater is moved by the BOP trolley and the BOP assembly is moved to an underwater storage position.

A damper may be further installed on an inner surface of the slot to absorb shock occurring between the slot and the risers.

The width of the slot may be larger than a diameter of the riser.

The drilling system may further include an auxiliary derrick installed on the derrick so as to receive and lift a casing pipe from a storage, and a trolley for a casing pipe located at the lower part of the derrick so as to assemble a plurality of casing pipes into a casing pipe assembly in cooperation with an auxiliary activity, and to move while supporting the casing pipe assembly thereon.

The auxiliary activity may include a crown block mounted on an upper portion of the derrick, a travelling block vertically moving along with the crown block, an elevator block mounted at the lower side of the travelling block so as to support the casing pipe, and a rotary table mounted to a drill floor so as to be located vertically below the travelling block.

According to the present invention having the above-mentioned features, when a drillship having the BOP assembly suspended underwater therefrom is required to move a short distance, the drillship can move with the BOP assembly suspended underwater without being drawn into the hull thereof, so that there is no need to disassemble and reassemble the BOP assembly, thereby improving convenience in various work and reducing working time.

Further, since the casing pipes can be assembled into a casing pipe assembly using the auxiliary activity, and if needed, the casing pipe assembly can be used using the activity after being stored in the trolley for a casing pipe assembly, drilling efficiency can be improved.

Figure 1:
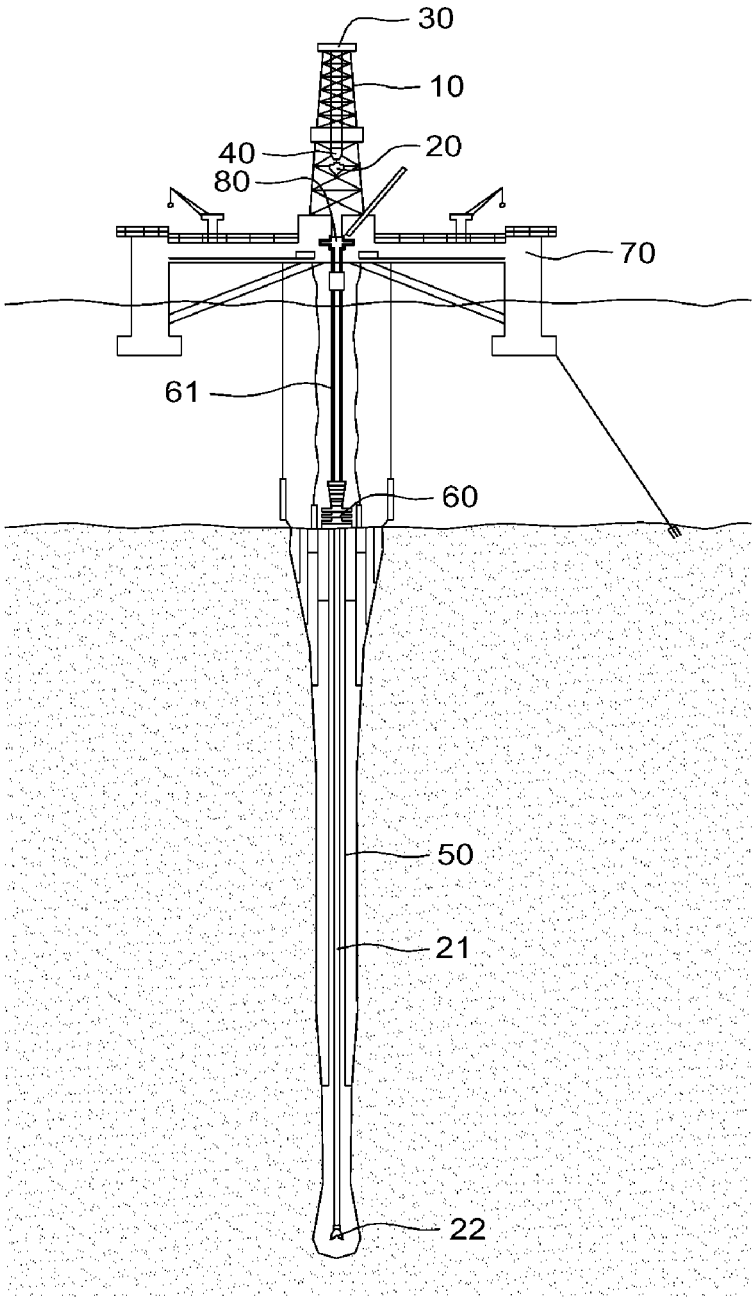
FIG. 1 (PRIOR ART)
FIG. 1 is a view showing the configuration of a conventional drilling system.

| <Description of the Reference Numerals in the Drawings> | |
|---|---|
| 110: Derrick | 120: Activity |
| 130: BOP trolley | 140: Slot |
| 150: Auxiliary activity | 151: Crown block |
| 152: Travelling block | 153: Elevator block |
| 154: Rotary table | 160: Trolley for casing pipe |
| 210: BOP assembly | 211: BOP |
| 212: riser | 220: Casing pipe assembly |

MODE FOR INVENTION

Hereinbelow, preferred embodiments of the present invention will be described in detail with reference to the accompanying drawings. In the following description, it is to be noted that, when the functions of conventional elements and the detailed description of elements related with the present invention may make the gist of the present invention unclear, a detailed description of those elements will be omitted.

Figure 2:
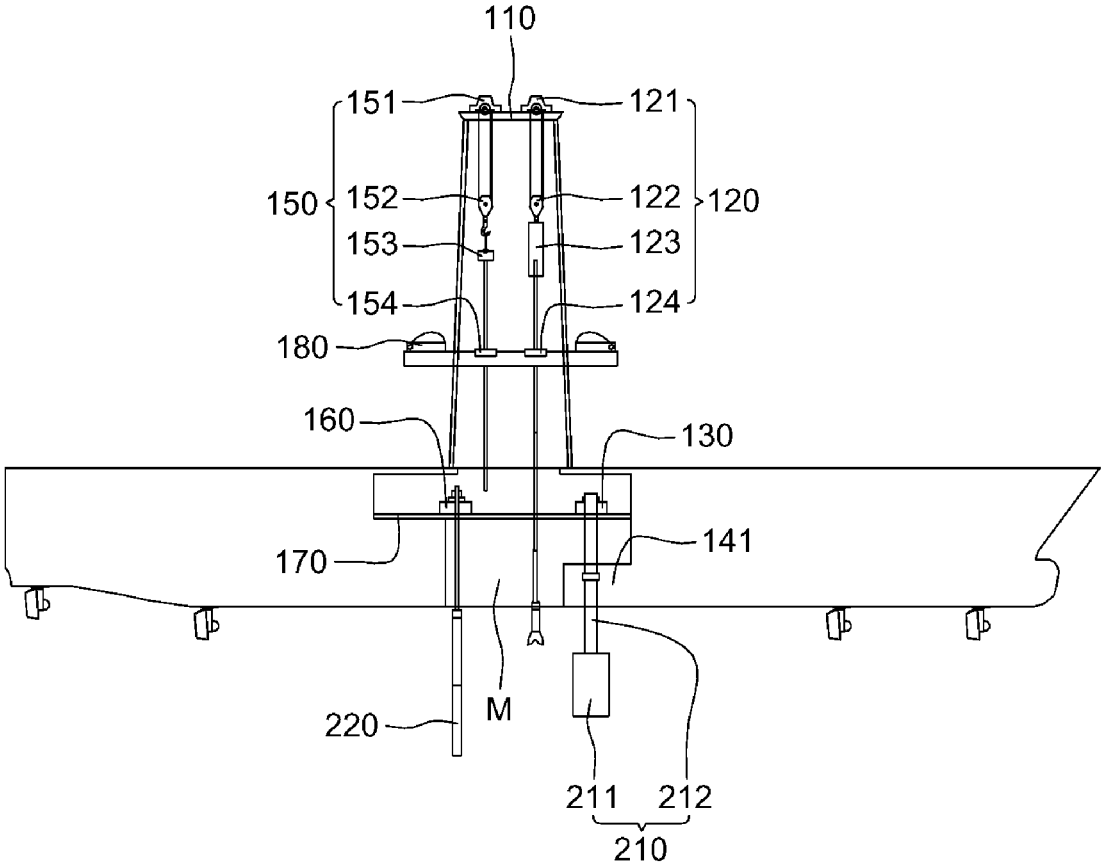
FIG. 2 is a side view of a drillship employing a drilling system according to a preferred embodiment of the present invention.
Figure 3:
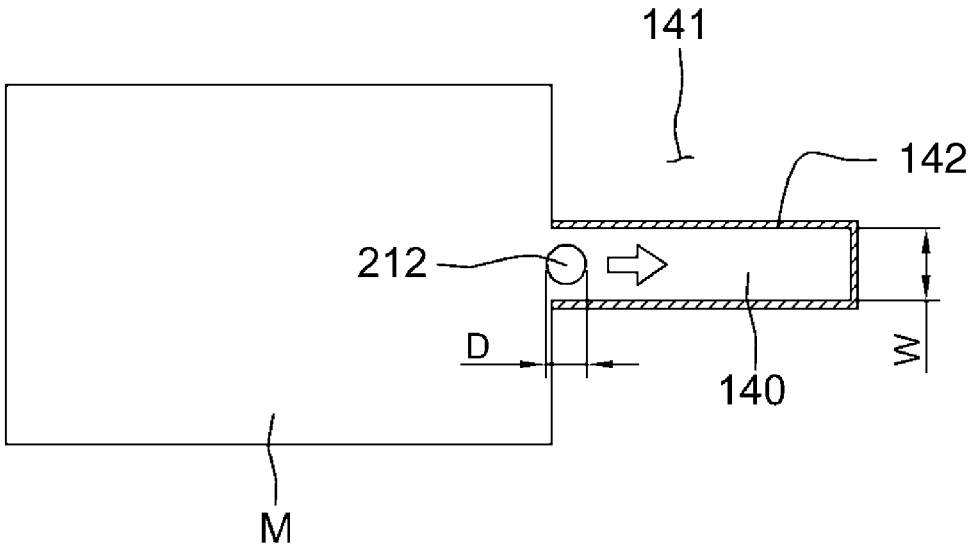
FIG. 3 is a plan view showing a slot of the drilling system, which is formed on a work stand of a moon pool.
Figure 4:
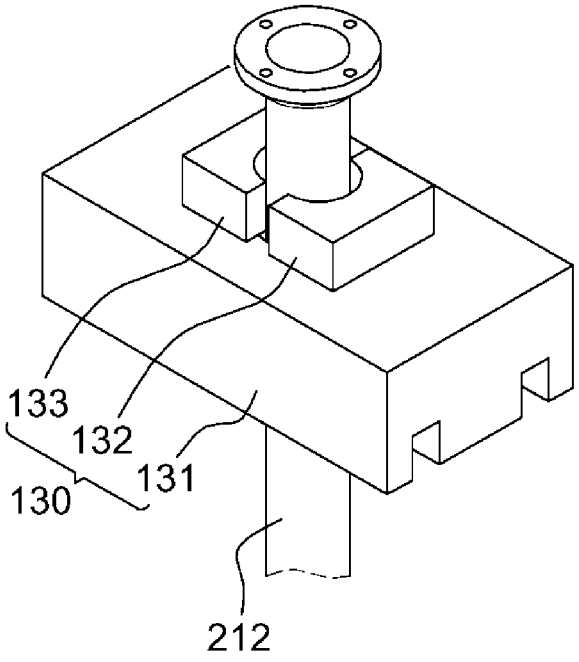
FIG. 4 is a perspective view of a BOP trolley of the drilling system.
Figure 5:
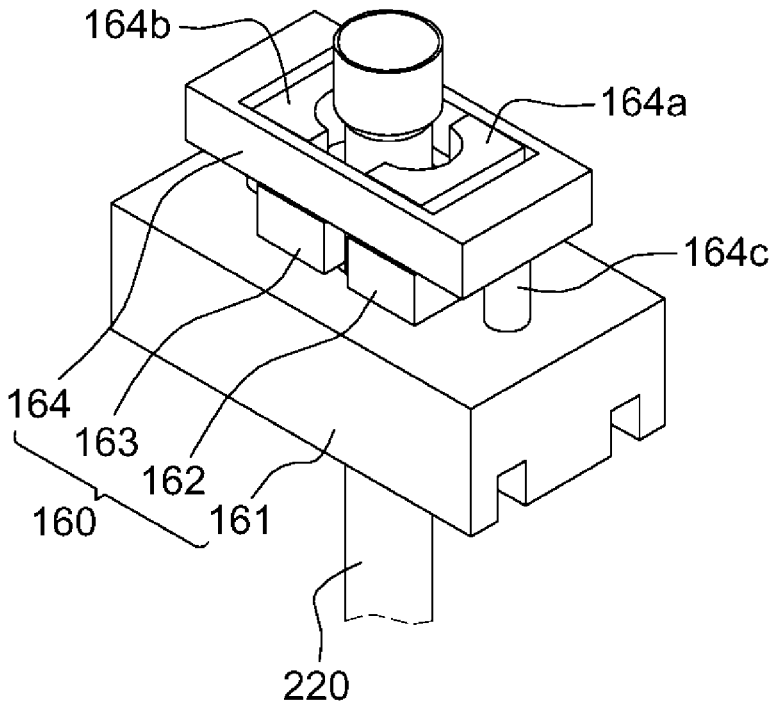
FIG. 5 is a perspective view of a trolley for a casing pipe of the drilling system.
Figure 6:
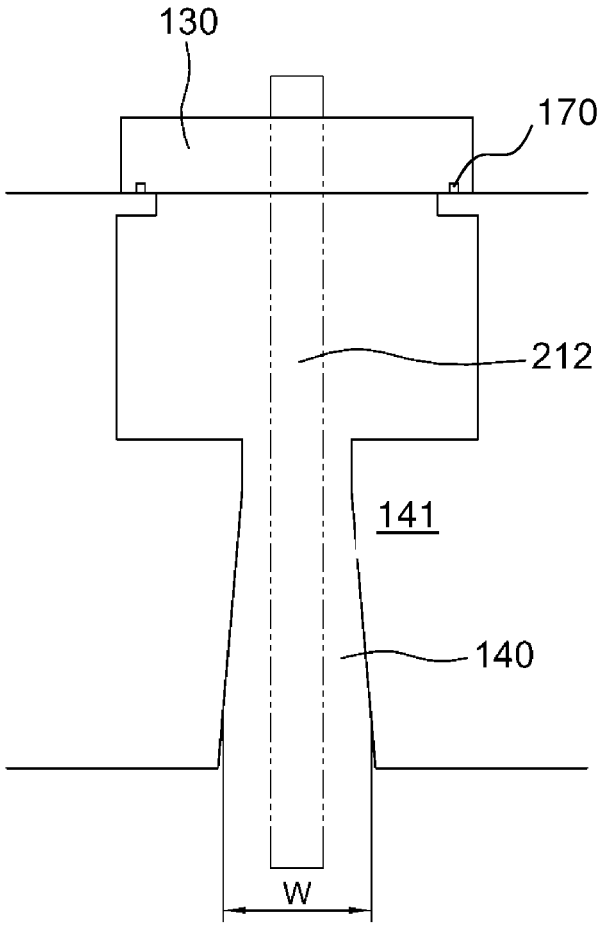
FIG. 6 is a cross-sectional view showing the structure of the slot of the drilling system.
Figure 7:
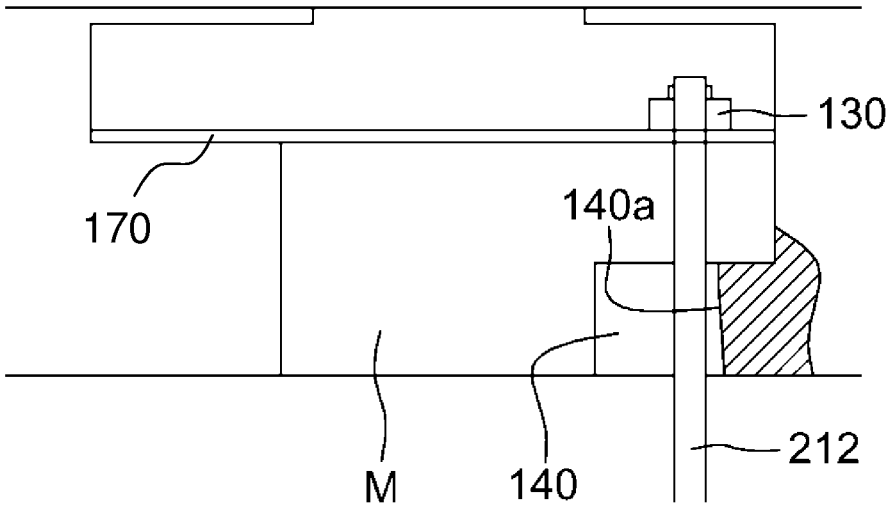
FIG. 7 is a side-sectional view showing the structure of the slot of the drilling system.

FIG. 2 is a side view of a drillship employing a drilling system according to a preferred embodiment of the present invention, FIG. 3 is a plan view showing a slot of the drilling system, which is formed on a work stand of a moon pool, FIG. 4 is a perspective view of a BOP trolley of the drilling system, FIG. 5 is a perspective view of a trolley for a casing pipe of the drilling system, FIG. 6 is a cross-sectional view showing the structure of the slot of the drilling system, and FIG. 7 is a side-sectional view showing the structure of the slot of the drilling system.

The drilling system of the present invention is characterized by the configuration in which, when a drillship which has a BOP assembly 210 suspended underwater therefrom is required to move a short distance for the formation of another borehole or for other purposes, the drillship can move while the BOP assembly 210 being moved to an underwater storage position without being drawn into the hull thereof. The drilling system includes a derrick 110, an activity 120, a blow out preventer (BOP) trolley 130, and a slot 140.

The derrick 110 is mounted on a platform of a stationary structure which is fixedly installed on a platform of the oil-producing region, or of a floating structure, such as a drillship, which is floatable, and may be formed into a variety of structures in association with H-beams, angles, steel plates or the like.

The activity 120 is mounted on the derrick 110 so as to implement the general work to form a borehole. The activity includes a crown block 121 which is mounted to the derrick 110, a travelling block 122 which is operatively coupled to the crown block 121 so as to vertically move along with the crown block 121, a top drive 123 which is supported by the travelling block 122 and is configured to be coupled with a drill pipe so as to rotate the drill pipe, and a rotary table 124 which is mounted on a drill floor vertically below the top drive 123. Here, the rotary table 124 is a well-known element used in a conventional drilling system, therefore a detailed description thereof will be omitted.

The BOP trolley 130 serves to assemble a plurality of risers 212 and BOPS 211 into a BOP assembly 210 and moves the BOP assembly while supporting the BOP assembly, in cooperation with the activity 120.

The BOP trolley 130 is mounted to be moved horizontally along a rail 170, which is installed on a floor of the platform, and includes a main body 131 through which the riser 212 passes, and a pair of spiders 132 and 133 which is mounted on the main body 131 to move close to or away each other from the riser 212 so as to support the riser.

The main body 131 may be provided with a drive source such as its own drive engine, electric drive motor or hydraulic drive motor, or otherwise may be coupled with a separate hydraulic cylinder so as to move along the rail 170. The pair of spiders 132 and 133 may be operated using a rack and pinion gear or a hydraulic cylinder.

The slot 140 is provided in a work stand 141 of a moon pool M, which is disposed in a drillship, so as to suppress excessive shaking of the riser 212, extending from the BOP assembly 210, while guiding movement of the riser, when the BOP assembly 210 positioned underwater is moved to its storage position.

The slot 140 is formed in the work stand 141 to have a structure extending parallel with the direction in which the BOP trolley moves, and the width thereof is larger than a diameter of the riser so as to allow stable movement of the riser as well as to prevent excessive shaking of the rider.

A damper 142 may preferably be further provided on an inner surface of the slot 140 in order to absorb shock occurring between the slot 140 and the riser due to possible shaking occurring during movement of a drillship. The damper 142 may be an elastic material such as rubber, or a urethane coating, which is applied to the inner surface of the slot 140.

The slot 140 is preferably formed to have a trapezoidal sectional shape whose width W increases towards its lower portion, taking account of shaking of the riser 212 supported by the BOP trolley 130 during movement of a drillship or due to surging waves of seawater.

More preferably, a front side 140*a* of the slot 140 is formed to have an inclined structure downwardly inclined towards a bow of a drillship, taking account of shaking of the riser 212.

The trapezoidal sectional shape of the slot 140 and the inclined front side 140*a* of the slot 140 allow the lateral side of the riser 212, extending from the BOP assembly 210, to come into uniform contact with the lateral side of the slot 140 when the BOP assembly 210 moved to the underwater storage position shakes, thereby stably suppressing excessive shaking of the BOP assembly 210.

The single activity 120 type drilling system of the present invention may further include an auxiliary activity 150 and a trolley 160 for a casing pipe in order to simultaneously perform assembly into a casing pipe assembly 220 during operation of the activity 120.

The auxiliary activity 150 is mounted on the derrick 110 adjacent to the activity 120, and serves to receive and lift casing pipes from a storage in a drillship by means of a known pipe-handling device, and to assemble the plurality of casing pipes into the casing pipe assembly 220 in cooperation with the trolley 160 for a casing pipe.

The auxiliary activity 150 includes a crown block 151 which is mounted on the upper portion of the derrick 110, a travelling block 152 which is vertically moved by the crown block 151, an elevator block 153 which is mounted at the lower side of the travelling block 152 so as to support the casing pipe, and a rotary table 154 which is mounted on a drill floor vertically below the travelling block 152. Here, since the crown block 151, the travelling block 152 and the rotary table 154 are the same structure as the elements 121, 122, and 124 of the activity 120, a detailed description thereof will be omitted.

The elevator block 153 is coupled to a lower end of the travelling block 152 so as to vertically move along with a vertical motion of the travelling block 152 produced by draw works 180, thereby supporting a variety of pipes such as casing pipes or drill pipes.

The trolley 160 for a casing pipe is mounted to be horizontally moved along a rail 170, which is mounted on a floor of a platform for movement of the BOP trolley 130, and includes a main body 161 through which a casing pipe passes, a pair of spiders 162 and 163 which is mounted on the main body 161 to move close to or away each other from the casing pipe assembly 220 so as to support the casing pipe assembly 220, and an elevator 164 which elevates the casing pipe assembly 220 supported by the trolley 160 for a casing pipe for combination with the activity 120.

Here, the main body 161 may be provided with a drive source such as its own drive engine, electric drive motor or hydraulic drive motor, or otherwise may be coupled with a separate hydraulic cylinder so as to move along the rail 170.

The pair of spiders 162 and 163 may be operated using a rack and pinion gear or a hydraulic cylinder, and the elevator 164 is provided with clamping jaws 164*a* and 164*b* for gripping the casing pipe assembly 220, and is vertically moved by the action of a hydraulic cylinder 164*c* which stands erect.

In order to form another borehole, the drilling system having the above-mentioned construction separates the BOP assembly 210, which was mounted in the previously formed borehole, from the borehole as follows. First, the BOP assembly 220 is separated from the borehole using the activity 120, some of risers placed on the BOP assembly 210 are separated from the BOP assembly, and the BOP assembly 210 is coupled to the BOP trolley 130 in a state where the BOP assembly is raised to approach the bottom of a drillship.

In the meantime, when the drillship is moved to form another borehole, the BOP assembly 210 coupled to the BOP trolley 130 often shakes underwater, so that it is preferred that the BOP assembly 210 be moved to a storage position to prevent shaking thereof.

Such a motion of the BOP assembly 210 is carried out as the BOP trolley 130 moves towards an edge (in the direction of arrow shown in FIG. 3) of the moon pool along the rail 170. Here, since the riser 212 extending from the BOP assembly 210 to the BOP trolley 130 is introduced into the slot 140 formed in the work stand 141 of the moon pool so that the shaking thereof is suppressed, shaking of the BOP assembly 210 occurring during movement of a drillship can be mitigated.

In the formation of installation of the drill pipe and carrying out drilling, using the activity 120, the auxiliary activity 150 and the trolley 160 for a casing pipe, which are provided in the derrick 110, can assemble the plurality of casing pipes into the casing pipe assembly 220, which will be stored in the trolley 160 for a casing pipe.

When a borehole is formed to a certain depth, the activity 120 draws the drill pipe and the drill bit, and then the drill pipe and the drill bit are removed from the activity 120.

Next, in order to couple the casing pipe assembly 220, stored in the trolley 160 for a casing pipe, to the activity 120, the trolley 160 for a casing pipe moves to a position vertically below the activity 120. Then, the elevator 164 grips the casing pipe assembly 220 using clamping jaws 164*a* and 164*b* and lifts it by a certain length. When the elevator 164 is operated, the pair of spiders 162 and 163, which is provided in the main body 161 of the trolley, moves away from each other so as to disengage the casing pipe assembly 220.

After the elevation of the casing pipe assembly 220 is completed, the pair of spiders 162 and 163 moves close to each other to engage the casing pipe assembly 220, and the clamping jaws 164*a* and 164*b* disengages the casing pipe assembly 220. In this state, the elevator moves down and then moves up while engaging the casing pipe assembly so as to lift the casing pipe assembly 220 to a certain length.

When the upper portion of the casing pipe assembly 220 approaches the activity 120 as the above-mentioned operation is repeated, the upper portion of the casing pipe assembly 220 and the top drive 123 are coupled each other. Then, when the casing pipe assembly 220 is moved down by the action of the activity 120, the casing pipe assembly 220 is finally installed. After the installation of the casing pipe assembly 220, cement is poured around the casing pipe assembly 220 so as to cement the casing pipe assembly 220.

When the installation of the casing pipe assembly 220 has been completed, the trolley 160 for a casing pipe is returned to its original position and operates to form another casing pipe assembly 220 together with the auxiliary activity 150. Here, the activity is equipped with a drill pipe so as to implement the formation of another borehole.

According to the present invention, a drillship can move a short distance while suspending the BOP assembly 210 underwater therefrom, thereby considerably improving working efficiency.

Further, since the casing pipes 220 can be assembled into a casing pipe assembly using the auxiliary activity 150 and the trolley 160 for a casing pipe during drilling operation, drilling efficiency can be advantageously improved.

Although the preferred embodiment(s) of the present invention have(has) been disclosed for illustrative purposes, those skilled in the art will appreciate that various modifications, additions and substitutions are possible, without departing from the scope and spirit of the invention as disclosed in the accompanying claims.

What is claimed is:

1. A drilling system comprising:

a platform forming a top of a stationary or floating structure;

a moon pool formed in said stationary or floating structure and having an opening opened to both a top side and a bottom side of said stationary or floating structure;

a work stand disposed at a bottom portion of the moon pool with being spaced away from the platform and protruding from a bow side of the moon pool toward a stern side of the moon pool;

a derrick installed on the platform over the moon pool of said stationary or floating structure;

a first activity installed on the derrick for forming a borehole in a sea-bed and carrying out installation of a casing pipe assembly and a blow out preventer (BOP) assembly in the formed borehole, the first activity including a first crown block mounted to the derrick, a first travelling block coupled to the first crown block and vertically moving along with the first crown block, a top drive supported by the first travelling block and coupled with a drill pipe;

a slot formed in the work stand with a narrower width than that of the opening of the moon pool, wherein a first end of the slot is connected to the opening of the moon pool, a second end of the slot extends toward the bow side of the moon pool, a top side of the slot is opened to the platform, and a bottom side of the slot is opened to underwater;

a rail installed under the platform in the moon pool of said stationary or floating structure;

a BOP assembly including at least one riser, and at least one BOP; and a BOP trolley moving on the rail while supporting the BOP assembly thereon and including a main body through which the riser passes, and a pair of spiders mounted on the main body and configured to hold the riser wherein when the riser is positioned in the slot, the BOP assembly is supported by the BOP trolley which is place on the rail, and a middle portion of the riser is held by the slot, thereby suppressing shaking of the riser.

2. The drilling system according to claim 1, wherein a damper is further installed on an inner surface of the slot to absorb shock occurring between the slot and the riser.

3. The drilling system according to claim 1, wherein a width (W) of the slot is greater than a diameter (D) of the riser.

4. The drilling system according to claim 1, further comprising:

a second activity installed on the derrick separately from the first activity for assembling a plurality of casing pipes into the casing pipe assembly and carrying the casing pipe assembly, the second activity including a second crown block mounted on the derrick, a second travelling block coupled to the second crown block and vertically moving along with the second crown block, and an elevator block mounted at a lower side of the second travelling block and supporting the casing pipe assembly; and a casing pipe trolley moving on the rail while supporting the casing pipe assembly thereon.

5. The drilling system according to claim 1, wherein the slot has a trapezoidal sectional shape whose width (W) increases towards a lower portion thereof.

* * * * *